US009437161B2

(12) United States Patent
Saito

(10) Patent No.: US 9,437,161 B2
(45) Date of Patent: Sep. 6, 2016

(54) IMAGE PROCESSING DEVICE FOR CORRECTING AN IMAGE TO BE DISPLAYED ON A DISPLAY BY DETECTING DARK SUB-PIXELS BETWEEN TWO BRIGHT SUB-PIXELS

(71) Applicant: PANASONIC CORPORATION, Osaka (JP)

(72) Inventor: Seiji Saito, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 324 days.

(21) Appl. No.: 14/164,030

(22) Filed: Jan. 24, 2014

(65) Prior Publication Data

US 2014/0139543 A1 May 22, 2014

Related U.S. Application Data

(63) Continuation of application No. PCT/JP2012/000438, filed on Jan. 24, 2012.

(30) Foreign Application Priority Data

Jul. 27, 2011 (JP) ..... 2011-164374

(51) Int. Cl.
*G09G 5/02* (2006.01)
*G09G 3/36* (2006.01)

(52) U.S. Cl.
CPC ..... *G09G 5/02* (2013.01); *G09G 3/3611* (2013.01); *G09G 2320/0242* (2013.01)

(58) Field of Classification Search
None
See application file for complete search history.

(56) References Cited

U.S. PATENT DOCUMENTS 6,542,161 B1 4/2003 Koyama et al.
7,102,655 B2 * 9/2006 Toji ..... G09G 5/02 345/591
2002/0135598 A1 * 9/2002 Tezuka ..... G09G 3/2003 345/613
2008/0049052 A1 * 2/2008 Akiyama ..... G02F 1/134309 345/694
2008/0049125 A1 * 2/2008 Subbotin ..... H04N 5/367 348/241

(Continued)

FOREIGN PATENT DOCUMENTS

JP 2001-100725 A 4/2001
JP 2011-118000 A 6/2011

OTHER PUBLICATIONS

International Search Report issued in International Application No. PCT/JP2012/000438 with Date of mailing May 1, 2012, with English Translation.

*Primary Examiner* — Michael J Cobb
(74) *Attorney, Agent, or Firm* — McDermott Will & Emery LLP

(57) ABSTRACT

In an image processing device which processes a video signal displayed on a display having sub-pixels arranged in a shape of stripes, a pixel scan section scans the video signal by two pixels adjacent in a direction orthogonal to the stripes and detects, in the two pixels, dark sub-pixels continuing by a number equivalent to one pixel or more between two bright sub-pixels each of which has a largest value in each of the two pixels, a correction target determination section determines at least one sub-pixel in the dark sub-pixels to be a correction target, a correction value computation section computes a correction value of the correction-target sub-pixel based on the values of the sub-pixels included in the two pixels, and a sub-pixel correction section increases the value of the correction-target sub-pixel by the correction value.

17 Claims, 9 Drawing Sheets

(56) References Cited

U.S. PATENT DOCUMENTS

2008/0158203 A1* 7/2008 Irie ..... G02F 1/13306 345/204
2010/0007587 A1 1/2010 Miller
2011/0227958 A1* 9/2011 Park ..... G09G 3/20 345/690
2014/0132580 A1* 5/2014 Hu ..... G09G 3/3614 345/96
2015/0170598 A1* 6/2015 Jeon ..... G09G 3/3611 345/96

* cited by examiner

IMAGE PROCESSING DEVICE FOR CORRECTING AN IMAGE TO BE DISPLAYED ON A DISPLAY BY DETECTING DARK SUB-PIXELS BETWEEN TWO BRIGHT SUB-PIXELS

CROSS-REFERENCE TO RELATED APPLICATIONS

This is a continuation of International Application No. PCT/JP2012/000438 filed on Jan. 24, 2012, which claims priority to Japanese Patent Application No. 2011-164374 filed on Jul. 27, 2011. The entire disclosures of these applications are incorporated by reference herein.

BACKGROUND

The present disclosure relates to an image processing device and an image display apparatus that correct an image to be displayed on a display to improve the reproducibility and fineness of the image.

Displays such as plasma displays and liquid crystal displays have been increasingly made larger in size and higher in definition, and have been used widely for TV sets, monitors of personal computers, etc. In such displays, sub-pixels for displaying key colors for color display are arranged on the plane. While the key colors emitted from the sub-pixels are separated from one another, they appear mixed since the sub-pixels are adjoining to one another, thereby permitting expression of neutral colors other than the key colors. These sub-pixels are previously allocated to designated compartments at the time of manufacturing the displays, and the arrangement thereof is also fixed at the time of manufacturing.

In displays having sub-pixels of the general three primary colors arranged in a striped shape, the sub-pixels in each pixel are often lined in RGB order. When red is present on the left and blue on the right next to red in an image displayed, only R sub-pixel is lit in the left-side pixel and only B sub-pixel is lit in the right-side pixel in pixel-by-pixel control. In this case, a total of four sub-pixels are present, not lit, between the R sub-pixel of the left-side pixel and the B sub-pixel of the right-side pixel. The portion of the image that can be displayed by four sub-pixels is equivalent to that of 1.3 pixels. Having such 1.3 pixel-equivalent sub-pixels being not lit means that a gap equivalent to 1.3 pixels is displayed as a black line.

There is conventionally known a character display apparatus that can display characters with high definition using a display device capable of color display (see Japanese Unexamined Patent Publication No. 2001-100725, for example). According to such a character display apparatus, jaggies at display of characters on a liquid crystal display are made inconspicuous by controlling sub-pixels individually, thereby permitting display of characters with high definition.

In the above conventional technique, which is specialized in character display, a gap still occurs in a color boundary portion between a red display region and a blue display region in the area other than portions involving characters and the background. In the arrangement of sub-pixels in RGB order from left, when red is on the left and blue on the right next to red on the screen, the gap of sub-pixels occurring in the color boundary portion is equivalent to 1.3 pixels. There is therefore the possibility that the gap may be visually recognized as if a black gap is present in the color boundary portion.

For the reason described above, there is a need for an image processing device that makes inconspicuous black lines occurring in color boundary portions of an image displayed on a display in which sub-pixels are arranged in a striped shape, to improve the reproducibility and fineness of the image.

SUMMARY

According to one aspect of the disclosure, an image processing device configured to process a video signal to be displayed on a display having sub-pixels arranged in a shape of stripes includes: a pixel scan section configured to scan the video signal by two pixels adjacent in a direction orthogonal to the stripes and detect, in the two pixels, dark sub-pixels continuing by a number equivalent to one pixel or more between two bright sub-pixels; a correction target determination section configured to determine at least one sub-pixel in the dark sub-pixels to be a correction target; a correction value computation section configured to compute a correction value of the correction-target sub-pixel based on the values of the sub-pixels included in the two pixels; and a sub-pixel correction section configured to increase the value of the correction-target sub-pixel by the correction value.

With the above configuration, in two pixels adjacent in the direction orthogonal to the stripes of sub-pixels, correction is made to increase the value of at least one sub-pixel in dark sub-pixels continuing by a number equivalent to one pixel or more between two bright sub-pixels. Accordingly, black gaps in the color boundary portions are made inconspicuous.

Preferably, the correction target determination section determines at least one sub-pixel in the dark sub-pixels except for sub-pixels at both ends.

As an example, the image scan section may detect a sub-pixel having a largest value from each of the two pixels as the two bright sub-pixels, and, if sub-pixels having a value smaller than a threshold or a relatively small value continue by a number equivalent to one pixel or more between the two detected sub-pixels, detect such sub-pixels as the dark sub-pixels.

As another example, the image scan section may detect the dark sub-pixels by selecting one arbitrary sub-pixel from each of the two pixels, and re-selecting a sub-pixel until the two selected sub-pixels correspond to the two bright sub-pixels and sub-pixels between the two selected sub-pixels correspond to the dark sub-pixels.

As yet another example, the image scan section may detect the dark sub-pixels by performing pattern matching for the two pixels using a pattern constituted by two bright sub-pixels and dark sub-pixels continuing by a number equivalent to one pixel or more between the bright sub-pixels.

DETAILED DESCRIPTION

Figure 1:
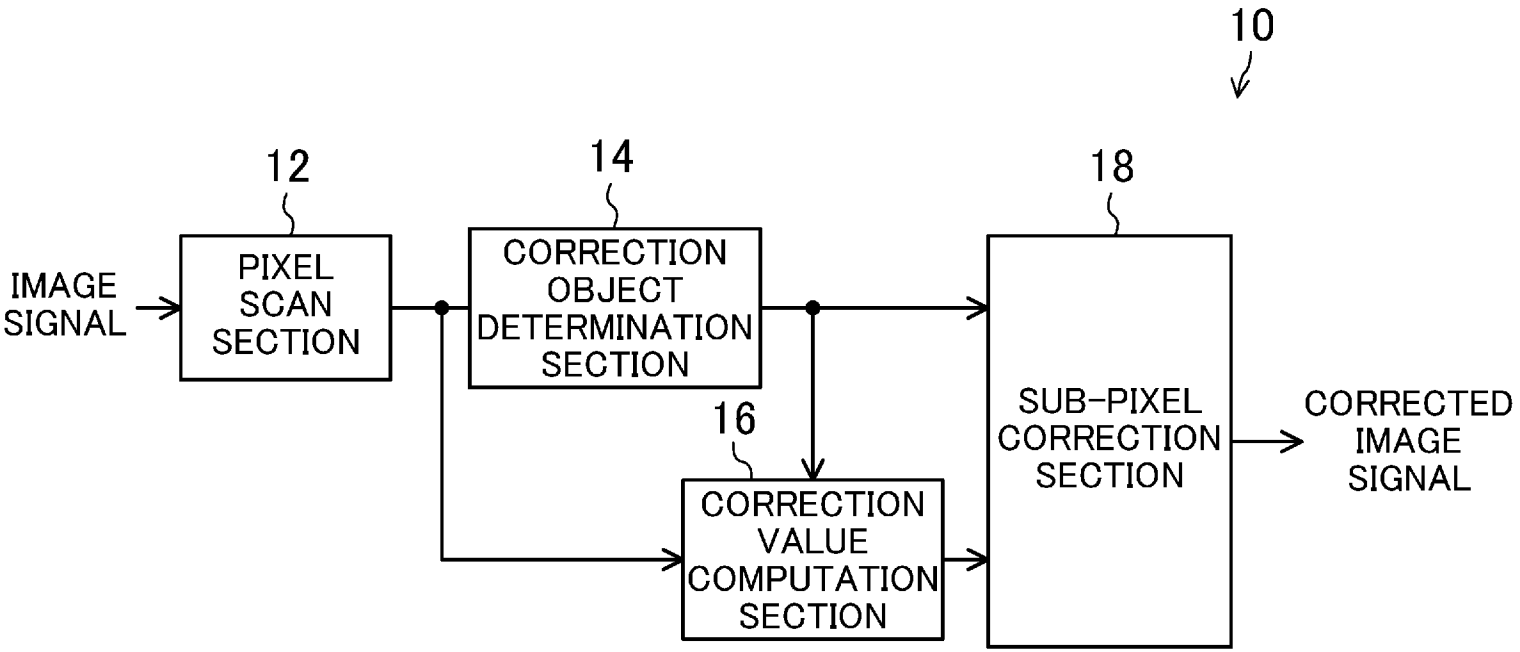
FIG. 1 is a block diagram of an image processing device of an embodiment of the present disclosure.

FIG. 1 shows a configuration of an image processing device of an embodiment of the present disclosure. The image processing device 10 includes a pixel scan section 12, a correction target determination section 14, a correction value computation section 16, and a sub-pixel correction section 18. The image processing device 10 can be implemented by a hardware unit such as a programmable device, a computer program executed by a CPU, etc., or the like. The image processing device 10 performs a correction, for an input video signal, of increasing the value of a sub-pixel satisfying a predetermined condition. The video signal input into the image processing device 10 is such a video signal that is displayed on a display in which sub-pixels are arranged in a striped shape such as a plasma display and a liquid crystal display. For convenience of description, the video signal is hereinafter assumed to be a video signal having RGB three primary colors although the image processing device 10 can also process a video signal having four or more primary colors.

Figure 2:
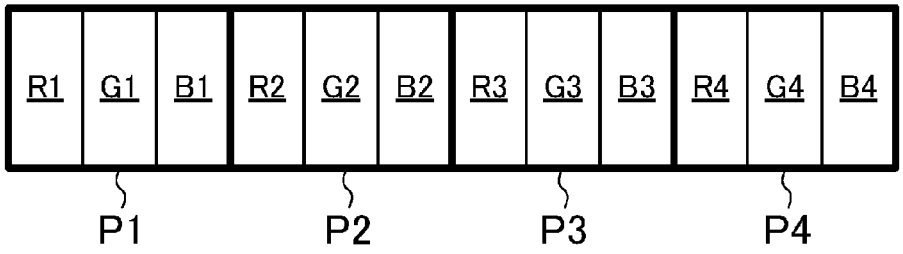
FIG. 2 is a diagrammatic view of pixels constituted by sub-pixels of three primary colors.

FIG. 2 diagrammatically shows pixels constituted by sub-pixels of three primary colors. Pixel P* (* is any of 1 to 4) is constituted by a sub-pixel R* that emits red light, a sub-pixel G* that emits green light, and a sub-pixel B* that emits blue light, and these sub-pixels are arranged in RGB order from left as viewed from front along a horizontal line of the display as illustrated. That is, in the example of FIG. 2, the stripes extend in the vertical direction of the display. Note that, although only four pixels are shown in FIG. 2, a number of pixels are arranged in the vertical and horizontal directions in the actual display. Note also that in some displays sub-pixels are arranged in RGB order from top or bottom as viewed from front. In such displays, the stripes extend in the horizontal direction of the display.

Referring back to FIG. 1, the pixel scan section 12 scans the input video signal by two pixels adjacent in the direction orthogonal to the stripes, and detects, in the two pixels, dark sub-pixels continuing by a number equivalent to one pixel or more between two bright sub-pixels. As used herein, a dark sub-pixel refers to 1) a sub-pixel that may be visually recognized as black when displayed on a display, e.g., a sub-pixel having a value smaller than a threshold, i.e., a sub-pixel having an absolutely small value and 2) a sub-pixel having a small value compared with the two bright sub-pixels, i.e., a sub-pixel having a relatively small value.

Figure 3:
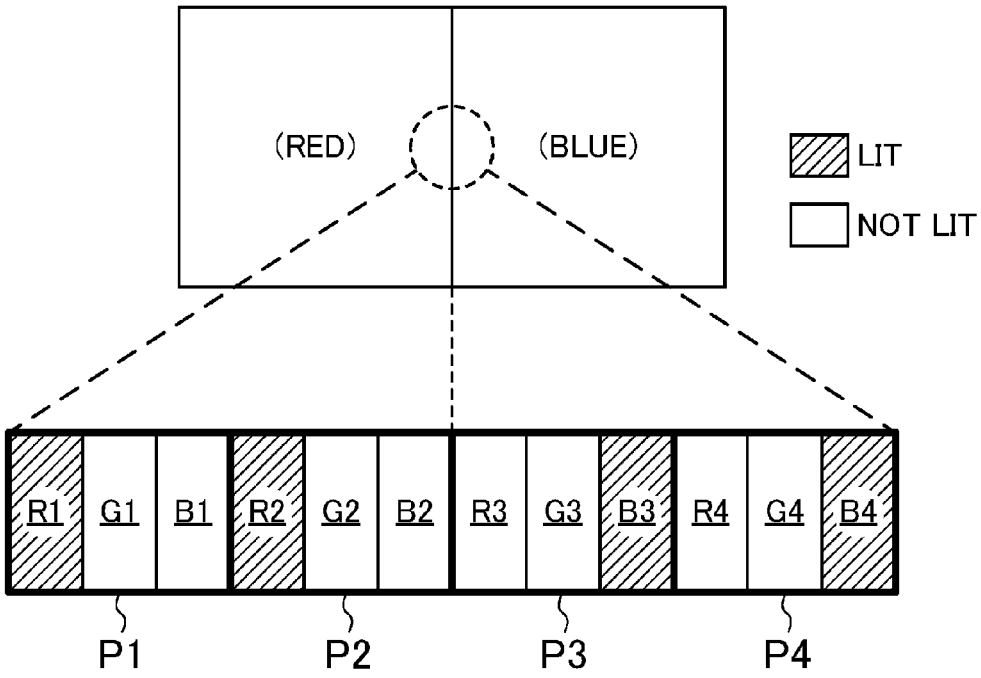
FIG. 3 is an enlarged diagrammatic view showing pixels in a color boundary portion between a red display region and a blue display region.
Figure 4:
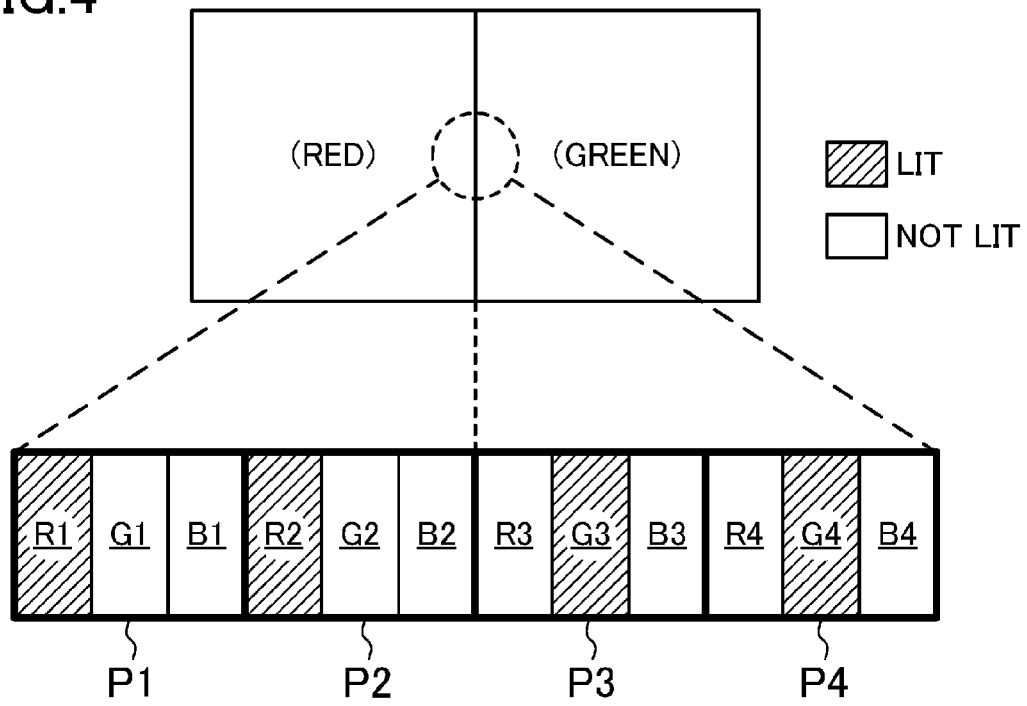
FIG. 4 is an enlarged diagrammatic view showing pixels in a color boundary portion between a red display region and a green display region.
Figure 5:
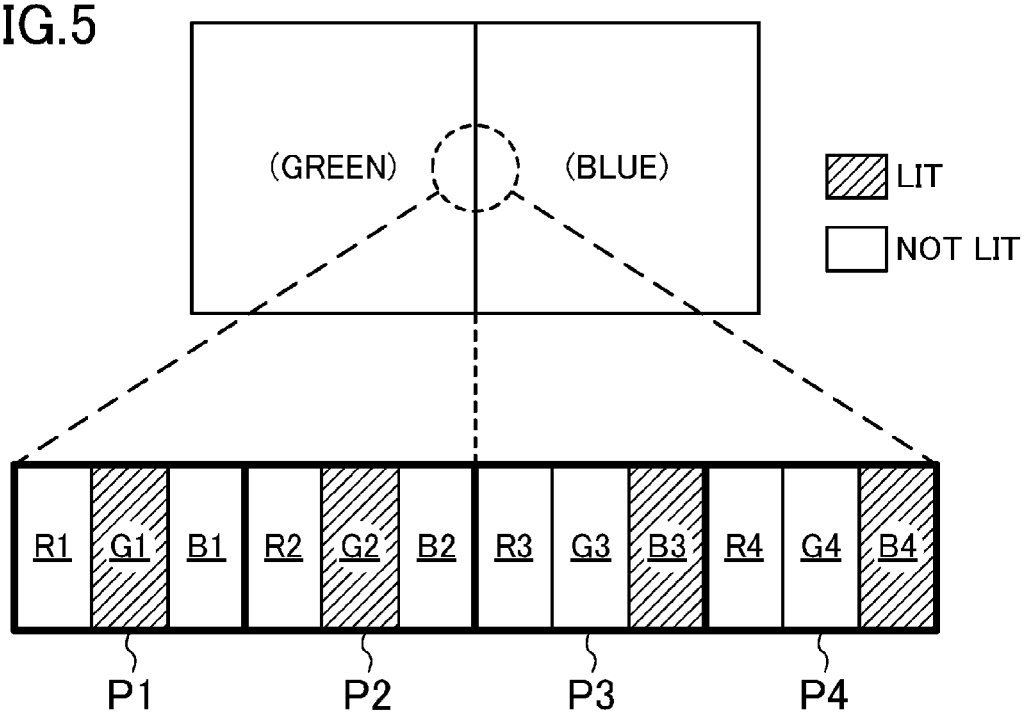
FIG. 5 is an enlarged diagrammatic view showing pixels in a color boundary portion between a green display region and a blue display region.

For example, as shown in FIG. 3, in the color boundary portion between the red display region and the blue display region, while the sub-pixel R2 of the pixel P2 and the sub-pixel B3 of the pixel P3 are bright because they are lit, the sub-pixels G2, B2, R3, and G3 in between are dark because they are not lit. Also, as shown in FIG. 4, for example, in the color boundary portion between the red display region and the green display region, while the sub-pixel R2 of the pixel P2 and the sub-pixel G3 of the pixel P3 are bright, the sub-pixels G2, B2, and R3 in between are dark. Similarly, as shown in FIG. 5, in the color boundary portion between the green display region and the blue display region, while the sub-pixel G2 of the pixel P2 and the sub-pixel B3 of the pixel P3 are bright, the sub-pixels B2, R3, and G3 in between are dark.

Some specific examples of detection of dark sub-pixels by the pixel scan section 12 will be described hereinafter.

<First Detection Method>

Figure 6:
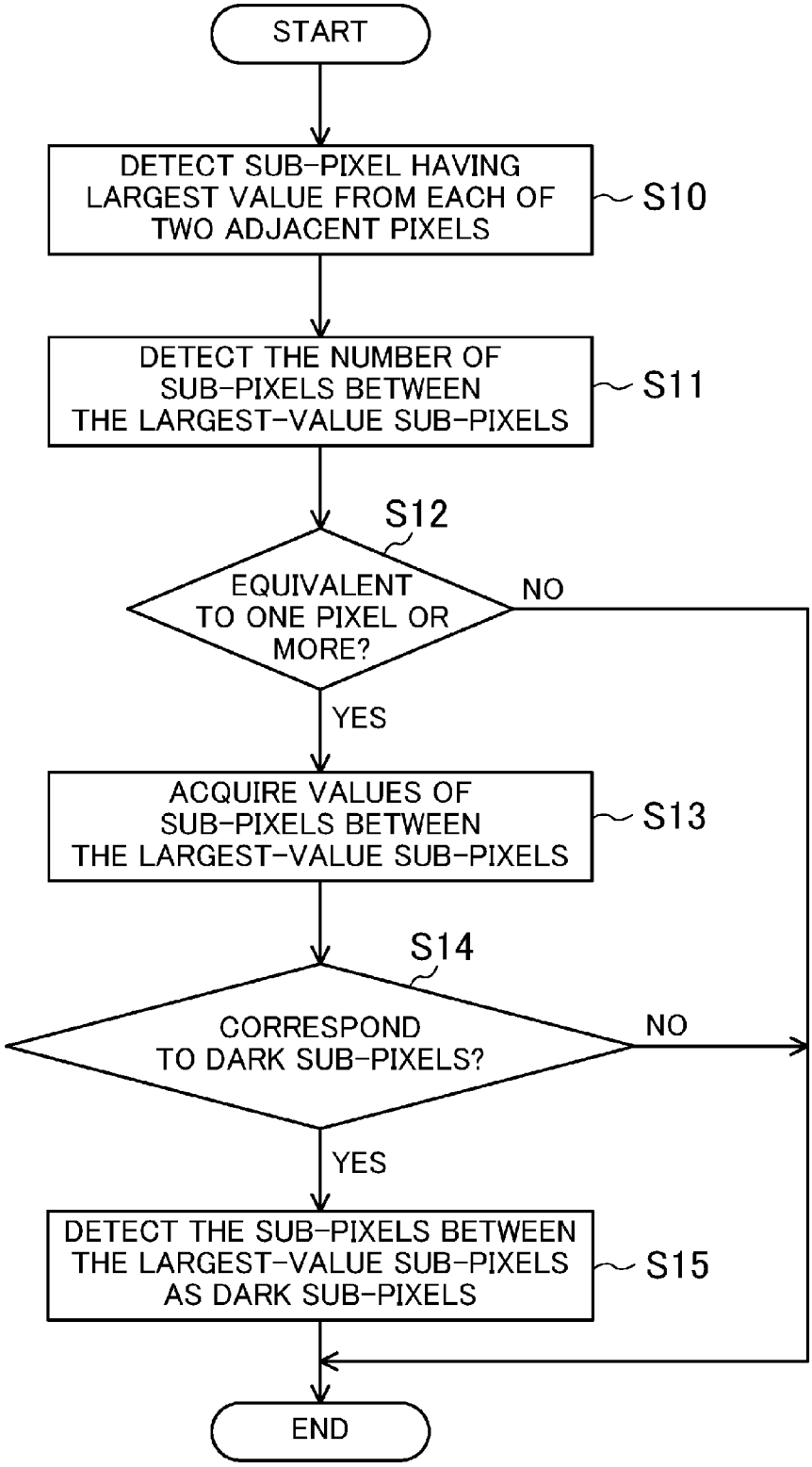
FIG. 6 is a flowchart of an example of dark sub-pixels detection.

FIG. 6 shows a flow of an example of dark sub-pixels detection. First, the pixel scan section 12 detects a sub-pixel having the largest brightness, i.e., the largest value, from each of two adjacent pixels based on the video signal of these pixels (S10). As the two pixels subjected to the processing, the following may be considered: 1) any two adjacent pixels, 2) two pixels in which all the sub-pixels have a value equal to or more than a given value, 3) two pixels in which the average value of the sub-pixels is equal to or more than a given value, and 4) two pixels in which the total value of the sub-pixels is equal to or more than a given value. Which one of these conditions should be used may be determined depending on features such as the pixel pitch of the display on which the corrected video signal is to be displayed.

Thereafter, the image scan section 12 detects the number of sub-pixels present between the detected sub-pixels having the largest value (hereinafter such sub-pixels are referred to as in-between sub-pixels) (S11). If the number of in-between sub-pixels is not equivalent to one pixel or more (NO in S12), the detection processing is terminated. The number equivalent to one pixel is three for a video signal having three primary colors, and four for a video signal having four primary colors. Thus, having the number corresponding to one pixel varying with the number of primary colors of the video signal, the number equivalent to one pixel may not be fixed but designated by a parameter.

If the number of in-between sub-pixels is equivalent to one pixel or more (YES in S12), the pixel scan section 12 acquires the values of the in-between sub-pixels (S13). Then, if the in-between sub-pixels do not correspond to dark sub-pixels (NO in S14), the detection processing is terminated. If corresponding to dark sub-pixels (YES in S14), the in-between sub-pixels are detected as the dark sub-pixels (S15). As the criterion for determination on whether the in-between sub-pixels correspond to dark sub-pixels, the following may be considered: 1) all the in-between sub-pixels irrespective of their values, 2) whether the value of each of the in-between sub-pixels is less than a given value, 3) whether the total value of the in-between sub-pixels is less than a given value, 4) whether the average value of the in-between sub-pixels is less than a given value, and 5) whether the difference between the value of each of the in-between sub-pixels and the largest value is equal to or more than a given value. Which one of these criteria should be used may be determined depending on features such as the pixel pitch of the display on which the corrected video signal is to be displayed.

<Second Detection Method>

Figure 7:
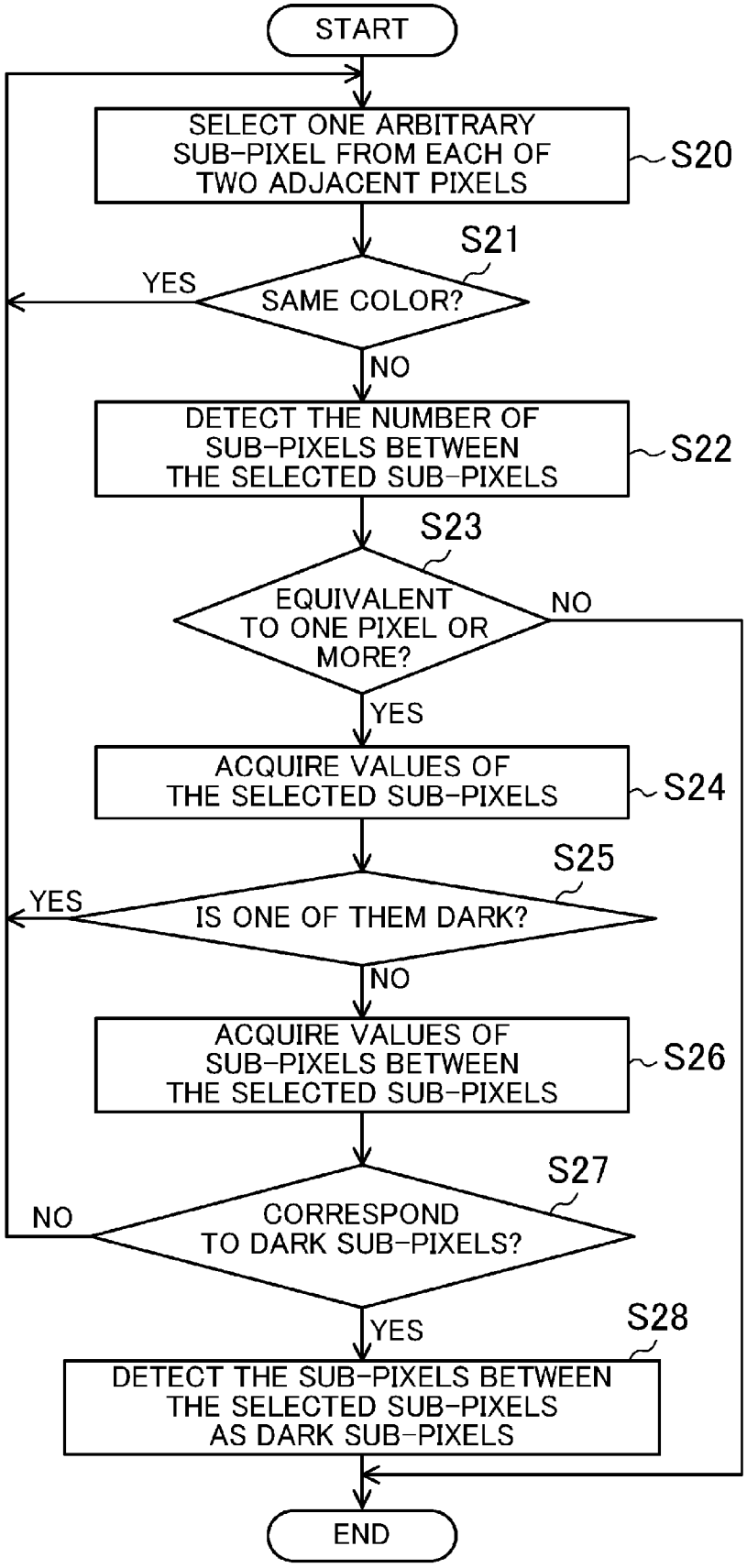
FIG. 7 is a flowchart of another example of dark sub-pixels detection.

FIG. 7 shows a flow of another example of dark sub-pixels detection. First, the pixel scan section 12 selects one arbitrary sub-pixel from each of two adjacent pixels based on a video signal of these pixels (S20). If the two selected sub-pixels are the same in color (YES in S21), the process returns to step S20 to select another sub-pixel. If they are not the same in color (NO in S21), the pixel scan section 12 detects the number of sub-pixels present between the selected sub-pixels (hereinafter such sub-pixels are referred to as in-between sub-pixels) (S22). If the number of in-between sub-pixels is not equivalent to one pixel or more (NO in S23), the detection processing is terminated. The number equivalent to one pixel is three for a video signal having three primary colors, and four for a video signal having four primary colors. Thus, having the number corresponding to one pixel varying with the number of primary colors of the video signal, the number equivalent to one pixel may not be fixed but designated by a parameter.

If the number of in-between sub-pixels is equivalent to one pixel or more (YES in S23), the pixel scan section 12 acquires the values of the two selected sub-pixels (S24). If one of the sub-pixels is dark, i.e., small in value (YES in S25), the process returns to step S20 to select a sub-pixel different from the dark sub-pixel. If both of the two selected sub-pixels are bright (NO in S25), the pixel scan section 12 acquires the values of the in-between sub-pixels (S26). If the in-between sub-pixels do not correspond to dark sub-pixels (NO in S27), the process returns to step S20 to select another sub-pixel. If corresponding to dark sub-pixels (YES in S27), the in-between sub-pixels are detected as the dark sub-pixels (S28). The criterion for determination on whether the in-between sub-pixels correspond to dark sub-pixels is as described above.

Note that, in step S24, the detection processing may be made to proceed to step S25 if 1) the value of each of the two selected sub-pixels is equal to or more than a given value, 2) the average value of the two selected sub-pixels is equal to or more than a given value, or 3) the total value of the two selected sub-pixels is equal to or more than a given value, or otherwise be terminated. Which one of these conditions should be used may be determined depending on features such as the pixel pitch of a display on which a corrected video signal is to be displayed.

<Third Detection Method>

Figure 8:
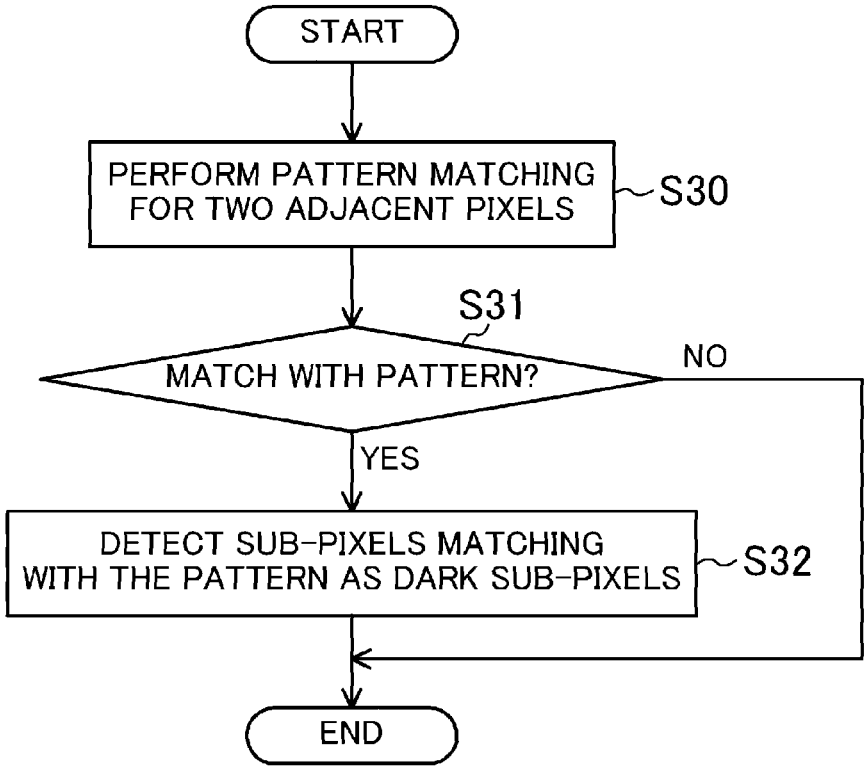
FIG. 8 is a flowchart of yet another example of dark sub-pixels detection.

FIG. 8 shows a flow of dark sub-pixels detection in yet another example. First, the pixel scan section 12 performs pattern matching for two adjacent pixels based on a video signal of these pixels. Examples of the pattern used include 1) a pattern of two bright sub-pixels and three dark sub-pixels between the bright sub-pixels, 2) a pattern of two bright sub-pixels and four dark sub-pixels between the bright sub-pixels, and 3) a pattern of two bright sub-pixels and five dark sub-pixels between the bright sub-pixels. Note that the pattern listed third is a pattern used when the video signal has four primary colors. Note also that the "bright" and "dark" natures in the patterns can be set in the form of thresholds.

If no sub-pixels matching with the pattern are found as a result of the pattern matching (NO in S31), the detection processing is terminated. If sub-pixels matching with the pattern are found (YES in S31), the sub-pixels matching with the "dark" sub-pixels in the pattern are detected as the dark sub-pixels (S32).

Returning back to FIG. 1, the correction target determination section 14 determines at least one sub-pixel in the dark sub-pixels detected by the pixel scan section 12 to be the correction target. As the correction target, the following can be considered: 1) a sub-pixel same in color as the darker one of the two bright sub-pixels, 2) a sub-pixel same in color as the brighter one of the two bright sub-pixels, 3) a sub-pixel adjacent to the darker one of the two bright sub-pixels, 4) a sub-pixel adjacent to the brighter one of the two bright sub-pixels, 5) a sub-pixel in the center of the dark sub-pixels, 6) a darker sub-pixel of two sub-pixels in the center of the dark sub-pixels, 7) a brighter sub-pixel of two sub-pixels in the center of the dark sub-pixels, 8) a sub-pixel, of two sub-pixels in the center of the dark sub-pixels, closer to the brighter one of the two bright sub-pixels, 9) a sub-pixel, of two sub-pixels in the center of the dark sub-pixels, closer to the darker one of the two bright sub-pixels, 10) a combination of any of the conditions of 1) to 9) above, and 11) all in the dark sub-pixels. Which one of these conditions should be used may be determined depending on features such as the pixel pitch of a display on which the corrected video signal is to be displayed.

The correction value computation section 16 computes a correction value of the correction-target sub-pixel determined by the correction target determination section 14 based on the values of the sub-pixels included in the two pixels scanned by the pixel scan section 12. As the correction value, the following can be considered: a) the value of one of the two bright sub-pixels that is the same in color as the correction-target sub-pixel, b) the value of the brighter one of the two bright sub-pixels, c) the value of the darker one of the two bright sub-pixels, d) the average value of the value of one of the two bright sub-pixels that is the same in color as the correction-target sub-pixel and the value of the sub-pixel before correction, e) the largest value of the dark sub-pixels, f) the average value of the dark sub-pixels, and g) the total value of the dark sub-pixels. Which one of these conditions should be used may be determined depending on features such as the pixel pitch of a display on which the corrected video signal is to be displayed.

The sub-pixel correction section 18 performs a correction of increasing the value of the correction-target sub-pixel determined by the correction target determination section 14 using the correction value computed by the correction value computation section 16, and outputs the corrected video signal.

Next, some examples of the processing of the video signal by the image processing device 10 of this embodiment will be described.

<Examples of Processing of Video Signal in FIG. 3>

In the adjacent pixels P1 and P2, where dark sub-pixels continuing by a number equivalent to one pixel or more is not detected, neither the dark sub-pixel G1 nor B1 is qualified as the correction target. Likewise, in the adjacent pixels P3 and P4, where dark sub-pixels continuing by a number equivalent to one pixel or more is not detected, neither the dark sub-pixel R4 nor G4 is not qualified as the correction target. In contrast, in the adjacent pixels P2 and P3, where the sub-pixels G2, B2, R3, and G3 are detected as dark sub-pixels continuing by a number equivalent to one pixel or more, and at least one of these sub-pixels is corrected.

Figure 9A:
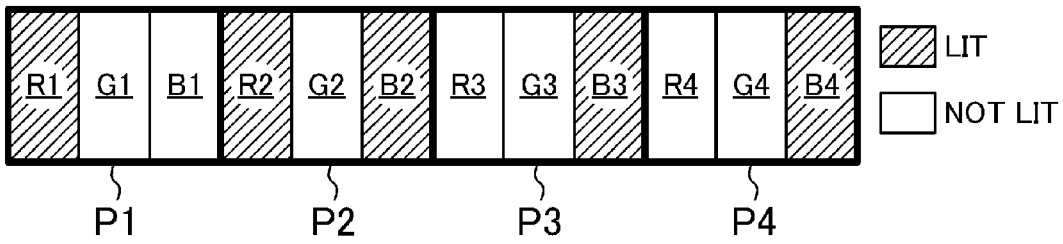
FIGS. 9A to 9D are views showing examples of results of processing of the video signal shown in FIG. 3.

FIGS. 9A to 9D show examples of results of the processing of the video signal in FIG. 3. In the example of FIG. 9A, the value of the sub-pixel B2 of the pixel P2 has been corrected. The sub-pixel B2 is determined to be the correction target in any one of the cases of i) following the condition of 1) above when the sub-pixel B3 is darker than the sub-pixel R2, ii) following the condition of 2) above when the sub-pixel B3 is brighter than the sub-pixel R2, iii) following the condition of 6) above when the sub-pixel B2 is darker than the sub-pixel R3, iv) following the condition of 7) above when the sub-pixel B2 is brighter than the sub-pixel R3, v) following the condition of 8) above when the sub-pixel R2 is brighter than the sub-pixel B3, and vi) following the condition of 9) above when the sub-pixel R2 is darker than the sub-pixel B3. Also, the value of the sub-pixel B2 has been corrected to be the same as that of the sub-pixel B3 according to the condition of a) above, for example.

Figure 9B:
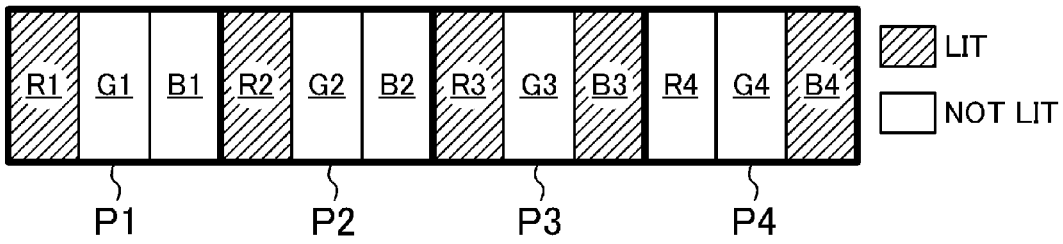

In the example of FIG. 9B, the value of the sub-pixel R3 of the pixel P3 has been corrected. The sub-pixel R3 is determined to be the correction target in any one of the cases of i) following the condition of 1) above when the sub-pixel R2 is darker than the sub-pixel B3, ii) following the condition of 2) above when the sub-pixel R2 is brighter than the sub-pixel B3, iii) following the condition of 6) above when the sub-pixel R3 is darker than the sub-pixel B2, iv) following the condition of 7) above when the sub-pixel R3 is brighter than the sub-pixel B2, v) following the condition of 8) above when the sub-pixel B3 is brighter than the sub-pixel R2, and vi) following the condition of 9) above when the sub-pixel B3 is darker than the sub-pixel R2. Also, the value of the sub-pixel R3 has been corrected to be the same as that of the sub-pixel R2 according to the condition of a) above, for example.

Figure 9C:
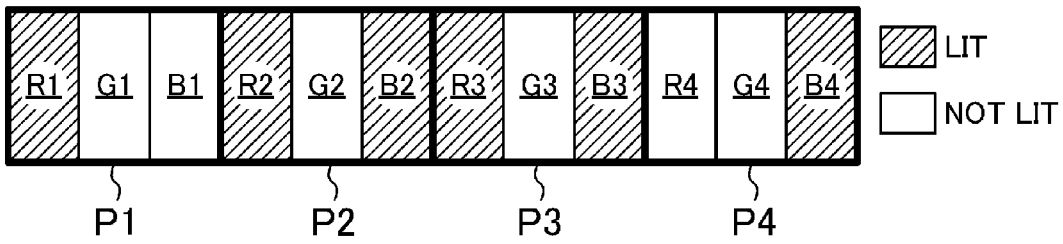

In the example of FIG. 9C, the values of the sub-pixel B2 of the pixel P2 and the sub-pixel R3 of the pixel P3 have been corrected. The sub-pixels B2 and R3 are determined to be the correction targets in any one of the cases of i) following the condition of 5) above, ii) combining the conditions of 1) and 2) above, iii) combining the conditions of 6) and 7) above, and iv) combining the conditions of 8) and 9) above. Also, the values of the sub-pixels B2 and R3 have been corrected to be the same as those of the sub-pixels B3 and R2, respectively, according to the condition of a) above, for example.

Figure 9D:
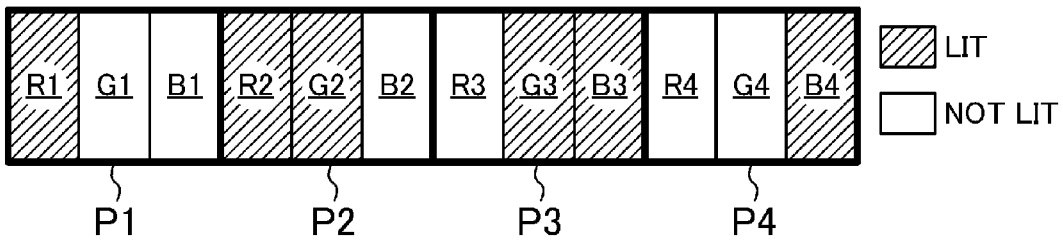

In the example of FIG. 9D, the values of the sub-pixel G2 of the pixel P2 and the sub-pixel G3 of the pixel P3 have been corrected. The sub-pixels G2 and G3 are determined to be the correction targets in the case of combining the conditions of 3) and 4) above. Also, the values of the sub-pixels G2 and G3 have been corrected according to any one of the conditions of b), c), e), f), and g) above.

Cases other than the above examples, such as the case of correcting only the sub-pixel G2 of the pixel P2 and the case of correcting only the sub-pixel G3 of the pixel P3, may be considered. In these cases, however, there still remains dark sub-pixels continuing by a number equivalent to one pixel or more after the correction. It is therefore preferable to determine at least one sub-pixel in the dark sub-pixels except for the sub-pixels at both ends to be the correction target.

<Examples of Processing of Video Signal in FIG. 4>

In the adjacent pixels P1 and P2, where dark sub-pixels continuing by a number equivalent to one pixel or more is not detected, neither the dark sub-pixel G1 nor B1 is qualified as the correction target. Likewise, in the adjacent pixels P3 and P4, where dark sub-pixels continuing by a number equivalent to one pixel or more is not detected, neither the dark sub-pixel B3 nor R4 is not qualified as the correction target. In contrast, in the adjacent pixels P2 and P3, where the sub-pixels G2, B2, and R3 are detected as dark sub-pixels continuing by a number equivalent to one pixel or more, and at least one of these sub-pixels is corrected.

Figure 10A:
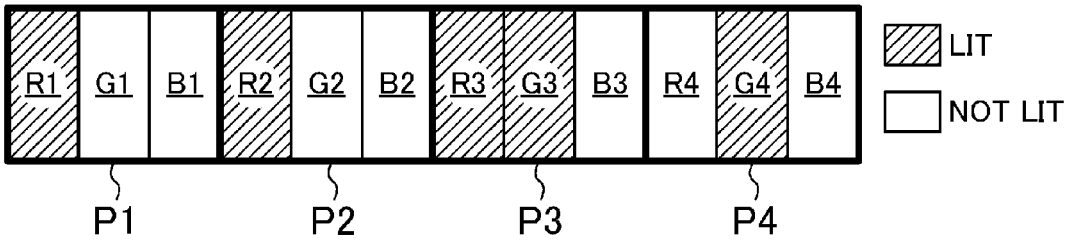
FIGS. 10A and 10B are views showing examples of results of processing of the video signal shown in FIG. 4.
Figure 10B:
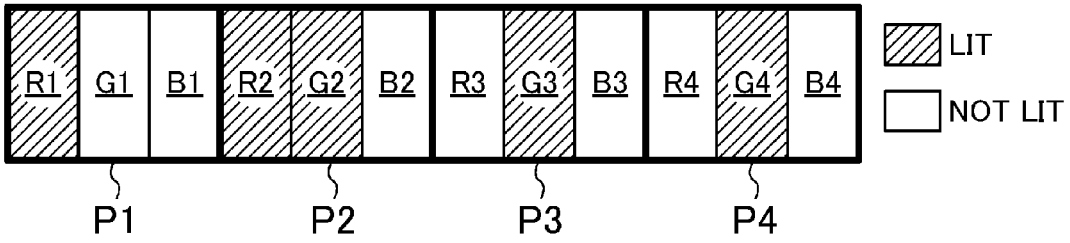

FIGS. 10A and 10B show examples of results of the processing of the video signal in FIG. 4. In the example of FIG. 10A, the value of the sub-pixel R3 of the pixel P3 has been corrected. The sub-pixel R3 is determined to be the correction target in any one of the cases of i) following the condition of 1) above when the sub-pixel R2 is darker than the sub-pixel G3, ii) following the condition of 2) above when the sub-pixel R2 is brighter than the sub-pixel G3, iii) following the condition of 3) above when the sub-pixel G3 is darker than the sub-pixel R2, and iv) following the condition of 4) above when the sub-pixel G3 is brighter than the sub-pixel R2. Also, the value of the sub-pixel R3 has been corrected to be the same as that of the sub-pixel R2 according to the condition of a) above, for example.

In the example of FIG. 10B, the value of the sub-pixel G2 of the pixel P2 has been corrected. The sub-pixel G2 is determined to be the correction target in any one of the cases of i) following the condition of 1) above when the sub-pixel G3 is darker than the sub-pixel R2, ii) following the condition of 2) above when the sub-pixel G3 is brighter than the sub-pixel R2, iii) following the condition of 3) above when the sub-pixel R2 is darker than the sub-pixel G3, and iv) following the condition of 4) above when the sub-pixel R2 is brighter than the sub-pixel G3. Also, the value of the sub-pixel G2 has been corrected to be the same as that of the sub-pixel G3 according to the condition of a) above, for example.

<Examples of Processing of Video Signal in FIG. 5>

In the adjacent pixels P1 and P2, where dark sub-pixels continuing by a number equivalent to one pixel or more is not detected, neither the dark sub-pixel B1 nor R2 is qualified as the correction target. Likewise, in the adjacent pixels P3 and P4, where dark sub-pixels continuing by a number equivalent to one pixel or more is not detected, neither the dark sub-pixel R4 nor G4 is not qualified as the correction target. In contrast, in the adjacent pixels P2 and P3, where the sub-pixels B2, R3, and G3 are detected as dark sub-pixels continuing by a number equivalent to one pixel or more, and at least one of these sub-pixels is corrected.

Figure 11A:
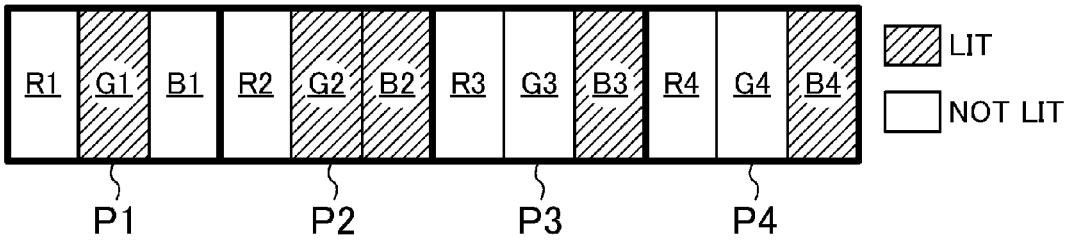
FIGS. 11A and 11B are views showing examples of results of processing of the video signal shown in FIG. 5.
Figure 11B:
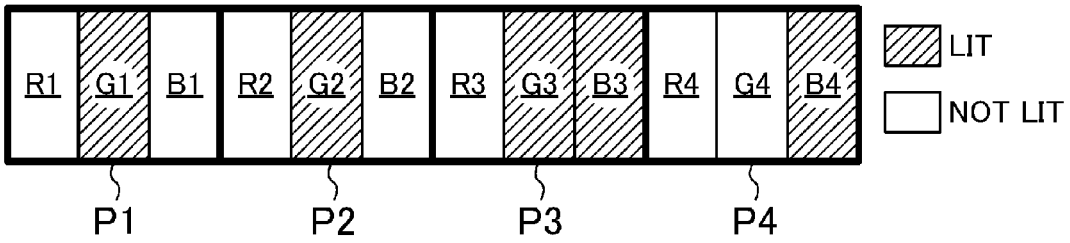

FIGS. 11A and 11B show examples of results of the processing of the video signal in FIG. 5. In the example of FIG. 11A, the value of the sub-pixel B2 of the pixel P2 has been corrected. The sub-pixel B2 is determined to be the correction target in any one of the cases of i) following the condition of 1) above when the sub-pixel B3 is darker than the sub-pixel G2, ii) following the condition of 2) above when the sub-pixel B3 is brighter than the sub-pixel G2, iii) following the condition of 3) above when the sub-pixel G2 is darker than the sub-pixel B3, and iv) following the condition of 4) above when the sub-pixel G2 is brighter than the sub-pixel B3. Also, the value of the sub-pixel B2 has been corrected to be the same as that of the sub-pixel B3 according to the condition of a) above, for example.

In the example of FIG. 11B, the value of the sub-pixel G3 of the pixel P3 has been corrected. The sub-pixel G3 is determined to be the correction target in any one of the cases of i) following the condition of 1) above when the sub-pixel G2 is darker than the sub-pixel B3, ii) following the condition of 2) above when the sub-pixel G2 is brighter than the sub-pixel B3, iii) following the condition of 3) above when the sub-pixel B3 is darker than the sub-pixel G2, and iv) following the condition of 4) above when the sub-pixel B3 is brighter than the sub-pixel G2. Also, the value of the sub-pixel G3 has been corrected to be the same as that of the sub-pixel G2 according to the condition of a) above, for example.

As described above, by processing the video signal by the image processing device 10 of this embodiment, there is no more any dark sub-pixels continuing by a number equivalent to one pixel or more between two bright sub-pixels. In this way, black lines in color boundary portions become inconspicuous, permitting improvement in the reproducibility and fineness of the image.

Note that a video signal that is dark as a whole, where black lines in color boundary portions are not so conspicuous, may be dropped from the target of the processing by the image processing device 10. This can reduce the power consumption of the image processing device 10.

The above-described video signal processing may be performed in parallel. For example, two pixels starting from an even-numbered pixel and two pixels starting from an odd-numbered pixel may be processed simultaneously. Otherwise, arbitrary two pixel pairs may be processed simultaneously. This can improve the processing speed.

In the parallel processing of the video signal, the following should be noted. In three continuous pixels, for example, assume that only the R sub-pixel is lit in the first pixel on the left, only the G sub-pixel is lit in the second pixel in the center, and only the B sub-pixel is lit in the third pixel on the right. In this state, if the R sub-pixel in the second pixel is corrected to be lit in the two-pixel signal processing for the first and second pixels, and the B sub-pixel in the second pixel is corrected to be lit in the two-pixel signal processing for the second and third pixels executed in parallel with the signal processing for the first and second pixels, all the sub-pixels will be lit in the corrected second pixel, causing the possibility of being visually recognized as white. Therefore, some measure should be taken, for a pixel that undergoes overlap processing, to prevent lighting of all the sub-pixels. As an example, a measure may be made not to correct sub-pixels at both ends of dark sub-pixels and to correct at least one sub-pixel in the remainder of the dark sub-pixels. With this, such a problem that all the sub-pixels of a pixel to be corrected may be lit.

(Embodiment of Image Display Apparatus)

Figure 12:
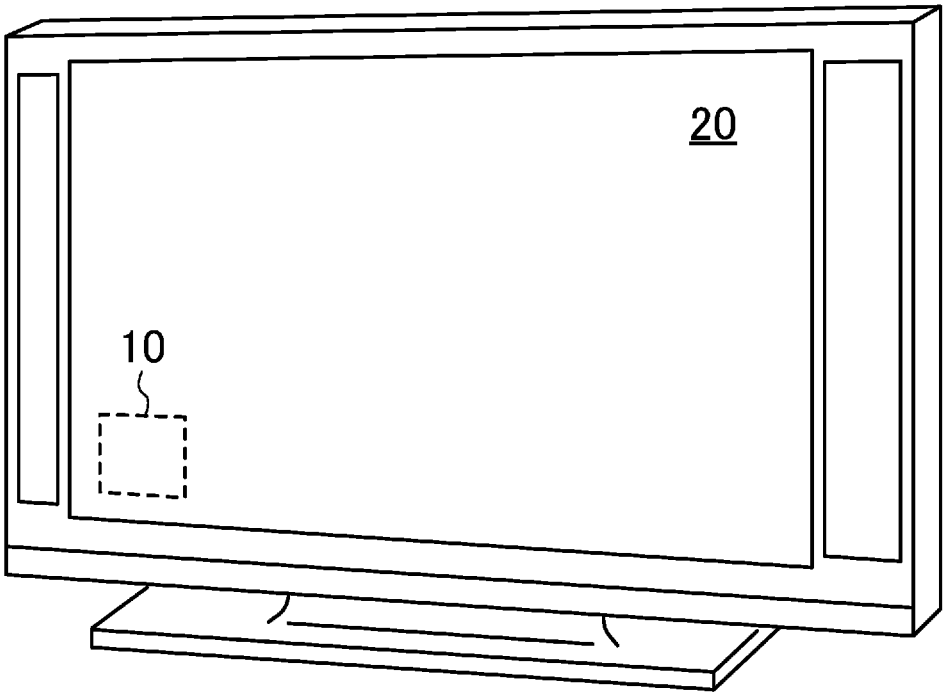
FIG. 12 is an appearance diagram of an image display apparatus of an embodiment of the present disclosure.

FIG. 12 shows an appearance of an image display apparatus of an embodiment of the present disclosure. The image display apparatus has the above-described image processing device 10 built in, and has a display 20 on which the video signal processed by the image processing device 10 is displayed. The display 20 is a display having sub-pixels arranged in a striped shape, such as a plasma display and a liquid crystal display. With this image display apparatus, where the video signal processed by the image processing device 10 is displayed on the display 20, black lines in color boundary portions become inconspicuous, and thus an image excellent in reproducibility and fineness can be presented to the user.

What is claimed is:

1. An image processing device configured to process a video signal to be displayed on a display having pixels each including sub-pixels having different colors, the sub-pixels being arranged in a shape of stripes, the image processing device comprising:

a processor; and a memory storing a program, wherein the program, when executed by the processor, configures the processor to have:

a pixel scan section configured to analyze the video signal by two pixels adjacent in a direction orthogonal to the stripes and detect, in the two pixels in each of which at least one sub-pixel is lit, dark sub-pixels continuing by a number equivalent to one pixel or more between two bright sub-pixels each of which has a largest value in each of the two pixels;

a correction target determination section configured to determine at least one sub-pixel in the dark sub-pixels to be a correction target;

a correction value computation section configured to compute a correction value of the correction-target sub-pixel based on values of the sub-pixels included in the two pixels; and a sub-pixel correction section configured to increase a value of the correction target sub-pixel by the correction value.

2. The image processing device of claim 1, wherein the correction target determination section determines at least one sub-pixel in the dark sub-pixels except for sub-pixels at both ends within the dark sub-pixels to be the correction target.

3. The image processing device of claim 1, wherein the pixel scan section detects the sub-pixel being lit and having the largest value from each of the two pixels as the two bright sub-pixels, and, if sub-pixels having a value smaller than a threshold value continue by a number equivalent to one pixel or more between the two detected sub-pixels, detects such sub-pixels as the dark sub-pixels.

4. The image processing device of claim 2, wherein the pixel scan section detects the sub-pixel being lit and having the largest value from each of the two pixels as the two bright sub-pixels, and, if sub-pixels having a value smaller than a threshold value continue by a number equivalent to one pixel or more between the two detected sub-pixels, detects such sub-pixels as the dark sub-pixels.

5. The image processing device of claim 1, wherein the pixel scan section detects the dark sub-pixels by selecting one arbitrary sub-pixel from each of the two pixels, and re-selecting a sub-pixel until the two selected sub-pixels correspond to the two bright sub-pixels and sub-pixels between the two selected sub-pixels correspond to the dark sub-pixels.

6. The image processing device of claim 2, wherein the pixel scan section detects the dark sub-pixels by selecting one arbitrary sub-pixel from each of the two pixels, and re-selecting a sub-pixel until the two selected sub-pixels correspond to the two bright sub-pixels and sub-pixels between the two selected sub-pixels correspond to the dark sub-pixels.

7. The image processing device of claim 1, wherein the pixel scan section detects the dark sub-pixels by performing pattern matching for the two pixels using a pattern constituted by two bright sub-pixels and dark sub-pixels continuing by a number equivalent to one pixel or more between the bright sub-pixels.

8. The image processing device of claim 2, wherein the pixel scan section detects the dark sub-pixels by performing pattern matching for the two pixels using a pattern constituted by two bright sub-pixels and dark sub-pixels continuing by a number equivalent to one pixel or more between the bright sub-pixels.

9. The image processing device of claim 1, wherein the pixel scan section detects in-between sub-pixels, which are sub-pixels between the two bright sub-pixels, as the dark sub-pixels, if the in-between sub-pixels continue by a number equivalent to one pixel or more and a total value of the in-between sub-pixels is less than a given value.

10. The image processing device of claim 2, wherein the pixel scan section detects in-between sub-pixels, which are sub-pixels between the two bright sub-pixels, as the dark sub-pixels, if the in-between sub-pixels continue by a number equivalent to one pixel or more and a total value of the in-between sub-pixels is less than a given value.

11. The image processing device of claim 1, wherein the pixel scan section detects in-between sub-pixels, which are sub-pixels between the two bright sub-pixels, as the dark sub-pixels, if the in-between sub-pixels continue by a number equivalent to one pixel or more and an average value of the in-between sub-pixels is less than a given value.

12. The image processing device of claim 2, wherein the pixel scan section detects in-between sub-pixels, which are sub-pixels between the two bright sub-pixels, as the dark sub-pixels, if the in-between sub-pixels continue by a number equivalent to one pixel or more and an average value of the in-between sub-pixels is less than a given value.

13. The image processing device of claim 1, wherein the pixel scan section detects in-between sub-pixels, which are sub-pixels between the two bright sub-pixels, as the dark sub-pixels, if the in-between sub-pixels continue by a number equivalent to one pixel or more and a difference between a value of each of the in-between subpixels and the largest value of the two bright sub-pixels is equal to or more than a given value.

14. The image processing device of claim 2, wherein the pixel scan section detects in-between sub-pixels, which are sub-pixels between the two bright sub-pixels, as the dark sub-pixels, if the in-between sub-pixels continue by a number equivalent to one pixel or more and a difference between a value of each of the in-between subpixels and the largest value of the two bright sub-pixels is equal to or more than a given value.

15. An image display apparatus, comprising:

the image processing device of claim 1; and a display configured to display the video signal processed by the image processing device.

16. An image processing device configured to process a video signal displayed on a display having pixels each including sub-pixels having different colors, the subpixels being arranged in a shape of stripes, the image processing device comprising:

a processor; and a memory storing a program, wherein the program, when executed by the processor, configures the processor to:

analyze the video signal by two pixels adjacent in a direction orthogonal to the stripes and detect, in the two pixels in each of which at least one sub-pixel is lit, dark sub-pixels continuing by a number equivalent to one pixel or more between two bright sub-pixels each of which has a largest value in each of the two pixels;

determine at least one sub-pixel in the dark sub-pixels to be a correction target;

compute a correction value of the correction-target sub-pixel based on values of the sub-pixels included in the two pixels; and increase a value of the correction-target sub-pixel by the correction value.

17. An image processing method for processing a video signal displayed on a display having pixels each including sub-pixels having different colors, the subpixels being arranged in a shape of stripes, the method comprising steps of:

analyzing, scanning the video signal by two pixels adjacent in a direction orthogonal to the stripes and detecting, in the two pixels in each of which at least one sub-pixel is lit, dark subpixels continuing by a number equivalent to one pixel or more between two bright sub-pixels each of which has a largest value in each of the two pixels, performed by a pixel scan section in a processor;

determining at least one sub-pixel in the dark sub-pixels to be a correction target, performed by a correction target determination section in the processor;

computing a correction value of the correction-target sub-pixel based on values of the sub-pixels included in the two pixels, performed by a correction value computation section in the processor; and increasing a value of the correction-target sub-pixel by the correction value, performed by a sub-pixel correction section in the processor.

* * * * *